US005588828A

United States Patent [19]

Nagata et al.

[11] Patent Number: 5,588,828

[45] Date of Patent: Dec. 31, 1996

[54] VERTICAL BRIGHT ANNEALING FURNACE FOR CONTINUOUS HEAT TREATMENT OF METAL STRIPS

[75] Inventors: Masato Nagata, Ikoma, Japan; José Cornejo, Algeciras-Cádiz, Spain

[73] Assignees: Chugai Ro Co., Ltd., Osaka, Japan; Acerinox, S.A., Madrid, Spain

[21] Appl. No.: 414,232

[22] Filed: Mar. 31, 1995

[30] Foreign Application Priority Data

Mar. 31, 1994 [JP] Japan ..... 6-062498

[51] Int. Cl.[6] ..... F27B 9/28

[52] U.S. Cl. ..... 432/59; 432/58; 432/95; 432/96; 432/121

[58] Field of Search ..... 432/59, 95, 96, 432/101, 120, 121, 58

[56] References Cited

FOREIGN PATENT DOCUMENTS

| | | |
|---|---|---|
| 836893 | 1/1939 | France . |
| 62-13985 | 1/1987 | Japan . |
| 2277723 | 11/1990 | Japan . |

OTHER PUBLICATIONS

NN, 'Inbetriebnahme eines', Stahl Und Eisen, 91–7, Apr. 1971.

H. Graetz et al., 'Energieeinsparung', S&E, 107–1, Jan. 1987.

H. W. Honervogt, 'Gluhanlage', S&E, 93–24, Nov. 1973.

M. Imose, 'Heating and Cooling', Transactions ISIJ, 25; 911–932.

Patent Abstracts of Japan, 11–357; Nov. 1987 JP–A–62 127426.

Patent Abstracts of Japan, 16–552; Nov. '92 JP–A–04 210431.

*Primary Examiner*—Henry A. Bennett
*Assistant Examiner*—Siddharth Ohri
*Attorney, Agent, or Firm*—Birch, Stewart, Kolasch & Birch, LLP

[57] ABSTRACT

A vertical bright-annealing furnace 1 for metal strips includes a muffle-type heating station 12, a refractory-type heating station 13. The refractory-type heating station 13 includes a shell 24 lined with a heat-insulating material 26 and a second heater 27. These two stations 12 and 13 are connected to one another by a flexible connecting unit 14 which is extensible in the longitudinal direction of the heating zone. A metal strip S conveyed in the furnace 1 is heated in the muffle-type heating station 12 and subsequently heated in the refractory-type heating station 13 up to a predetermined temperature, for example, about 1,100° C. According to this constitution, a large-sized vertical annealing furnace may be constructed. Also, the period of durability of the muffle may be extended, the running expenses may be decreased, and metal strip having good brightness may be produced.

5 Claims, 7 Drawing Sheets

VERTICAL BRIGHT ANNEALING FURNACE FOR CONTINUOUS HEAT TREATMENT OF METAL STRIPS

BACKGROUND OF THE INVENTION

1. Field of the Invention

The present invention relates to a vertical bright-annealing furnace for continuous heat treatment of metal strips and, more particularly, to a structure of a heating zone of a vertical bright-annealing furnace in which strips of a metal such as, for example, a stainless steel, copper or aluminum, are continuously annealed while keeping the brightness of surfaces thereof by heating the metal strips to an annealing temperature in a protective gas to prevent them from oxidation and decarbonization and then cooling the heated metal strips to a predetermined low temperature.

2. Description of the Prior Art

Conventionally, an up-heat type vertical bright-annealing furnace for annealing strips of a stainless steel is composed of (i) a heating zone which heats up an upward-moving strip to the first pre-set temperature, e.g. 1,100° C.; (ii) a slow-cooling zone which gradually reduces the temperature of the strip; (iii) a second cooling zone which reduces the temperature of the strip to the second pre-set temperature, e.g. 80° C.; (iv) a top-roll chamber which directs the cooled strip downward; (v) an outlet chute which directs and exits the downward-moving strip; and (vi) an inlet seal section, located at a section of the heating zone where the strip enters, and an outlet seal section located at the outlet chute section, both of which are located substantially at the same level to prevent the protective gas in the furnace from leaking out as well as to prevent the outside air from entering the furnace.

According to the structure of the heating zone, such vertical bright-annealing furnaces can be roughly classified into two types, i.e., (a) a muffle-type furnace and a refractory-type furnace. The former has a cylindrical muffle which is supported at its top and covers the entire heating zone; and burners and electric heaters heat the muffle which, in turns, heats the strip moving inside the muffle. The latter has walls made up of firebricks inside, covering the entire heating zone; and electric heaters heat the strip, moving inside the walls.

When comparing the muffle-type furnace with the refractory-type furnace, although the former has two advantages: (i) its dew-point adjustment time, i.e., a time required for adjustment of the protective gas in the furnace to the working condition, is only about twenty-four hours, and (ii) its running cost is low because of its low consumption of the protective gas, there are two disadvantages: (i) the maximum temperature in the furnace is only about 1,150° C. because of the heat-resistant steel used in the muffle, and (ii) the maximum length of the heating zone, i.e., the length of the muffle, is limited because of its weight, thus making it very difficult to make the furnace larger and more productive.

On the other hand, the latter refractory-type furnace is easier to make the furnace larger and enables to obtain the same level of productivity of the muffle-type with only seventy percent of the furnace length as the maximum temperature can be raised to 1,250° C. and above by use of high-heat resistant firebricks. However, it has disadvantages in that it takes about four to five days to bring up to the working condition at the beginning, and its running cost is high because of its high consumption of the protective gas.

SUMMARY OF THE INVENTION

It is therefore a main object of the present invention to provide a vertical bright-annealing furnace for continuous heat treatment of metal strips, which enables to achieve high productivity, short dew-point temperature adjustment time, low consumption of the protective gas, low running cost, and a large heating zone.

The above object of the present invention is achieved by combining the advantages of the both types of the furnaces to cancel the aforesaid disadvantages of the both types of the furnaces.

According to the present invention, there is provided a vertical continuous bright-annealing furnace for metal strips, comprising two heating stations, i.e., a muffle-type heating station and a refractory-type heating station, both stations being connected to one another by a flexible connecting unit, whereby a metal strip is heated up to a predetermined temperature in the refractory-type heating station after being heated in the muffle-type heating station.

The muffle-type heating station includes a cylindrical muffle through which a metal strip is conveyed, a metal shell that is lined with heat-insulating material, and first heating means for heating the muffle so as to indirectly heat the metal strip transported therein. The refractory-type heating station includes a metal shell lined with firebricks through which the metal strip is conveyed, and second heating means for heating the metal strip, which has been heated in the muffle-type heating station, to a predetermined temperature. These stations are connected by a flexible connecting unit so that the muffle-type heating station and the refractory-type station are in alignment with one another. The first heating means may comprises a plurality of burners or a plurality of electric heaters. Moreover, the metal shell of the muffle-type heating station may be divided into a fixed main part and a detachable part which is mounted on the muffle.

According to the present invention, the metal strip is conveyed through the muffle-type heating station and heated by a radiant heat from the muffle heated directly by the first heating means. After that, the metal strip is conveyed through the refractory-type heating station and heated by the second heating means up to the predetermined temperature.

Thus, according to the present invention, there is provided a vertical bright-annealing furnace for continuous heat treatment of metal strips, comprising a heating zone for heating a metal strip to a predetermined annealing temperature and a cooling zone for cooling the heated metal strip to a predetermined low temperature, said heating zone comprising:

- a muffle-type heating station composed of a metal shell lined with a heat-insulating material, a muffle arranged in said shell, and a first heating means for heating said muffle; and
- a refractory-type heating station arranged just above said muffle-type heating station and composed of a metal shell lined with a heat-insulating material, and a second heating means for heating said metal strip;
- said heating stations being connected to one another by a flexible connecting unit which is extensible in the longitudinal direction of the heating zone, whereby allowing the metal strip to pass through the refractory-type heating station subsequent to the muffle-type heating station to heat it to a predetermined annealing temperature.

The vertical bright-annealing furnace described above, which is a combination of the muffle-type and refractory-type heating stations, may allow the annealing furnace to be upsized.

Further, since the metal strip is finally heated up to about 1,100° C. in the refractory-type station, it is not necessary to heat the metal strip up to the same temperature but about 800° C. Consequently, the period of durability is further extended, which results in reduction in maintenance, running, and manufacturing costs.

Moreover, the stainless steel contains some chromium, and hydrogen in the atmospheric gas provides less deoxidization under the circumstance having temperature of about 800° C. or less, such that it is necessary to keep a humidity in the furnace as low as possible. With the vertical bright-annealing furnace of the present invention, the metal strip is heated up to the approximately same temperature, that is about 800°, in the muffle, and the humidity in the muffle will easily be kept lower than that in the refractory-type station. Consequently, the annealing furnace of the present invention is effected to anneal the metal strip with no its brightness deteriorated substantially.

Furthermore, the vertical bright-annealing furnace of the present invention requires less consumption of the atmospheric gas, less running expenses, and less controlling time for seasoning as compared with those of the refractory-type furnace.

BRIEF DESCRIPTION OF THE DRAWINGS

These and other objects and features of the present invention will become clear from the following description taken in conjunction with a preferred embodiment thereof with reference to the accompanying drawings throughout which like parts are designated by like reference numerals, and in which.

DETAILED DESCRIPTION OF THE INVENTION

Figure 1:
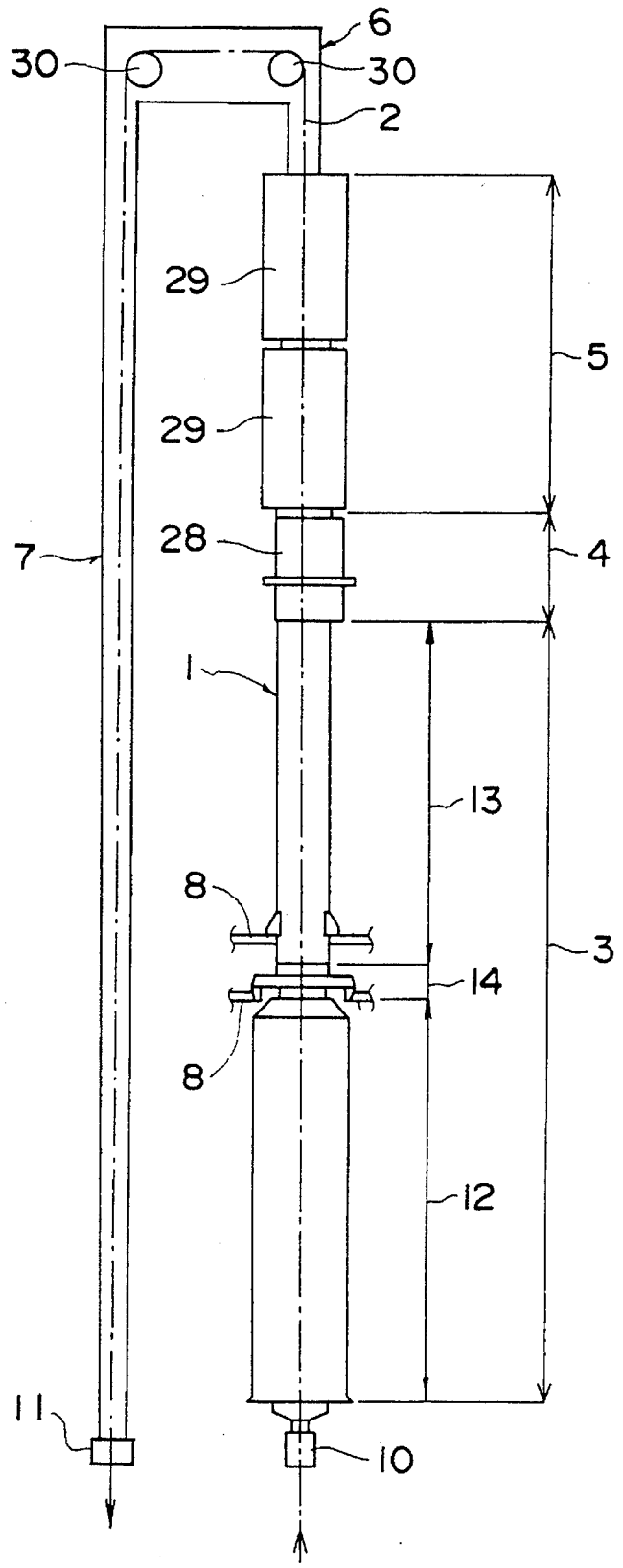
FIG. 1 is a schematic front view of a vertical bright-annealing furnace according to the present invention.

Referring to FIG. 1, there is shown a vertical furnace to be used for the continuous bright-annealing of the metal strip such as stainless steel indicated generally by 1.

This furnace 1 includes, along a one-way strip conveying path 2 illustrated by the phantom line, from downward to upward in order, a heating zone 3 for heating the metal strip at room temperature of about 20° C. up to about 1,100° C., a first cooling zone or slow-cooling zone 4 for cooling the heated metal strip slowly, and a second cooling zone 5 for cooling the metal strip down to about 80° C. The furnace 1 also includes a top-roll chamber 6 for deflecting the metal strip, which has been continuously transported upwardly, so as to move downward by suitable means, and an outlet chute 7 for the protection of the downward-moving metal strip. This furnace 1 of the above described construction is supported by a frame, only a part of which is shown by 8 in the FIGS. 1 and 2. Inside the heating zone 3, first cooling zone 4, second cooling zone 5, top-roll chamber 6 and outlet chute 7, there is formed a metal strip conveying channel 9 (see FIG. 2) surrounding the strip conveying path 2. This channel 9 has inlet and outlet portions defined at the same level with inlet and outlet sealing units 10 and 11 disposed at the inlet and outlet portions of the channel 9, respectively. The inlet sealing unit 10 is so designed to prevent the atmospheric gas inside the furnace from leaking to the outside while the outlet sealing unit 11 is so designed as to avoid an entry of an outdoor atmosphere or air into the furnace.

The heating zone 3 comprises a muffle-type heating station 12 and a refractory-type heating station 13 arranged downstream of the station 12 with respect to the direction of transport of the metal strip, that is, adjacent to the slow-cooling zone 4, these two stations 12 and 13 being joined together through a connecting unit 14.

Figure 2:
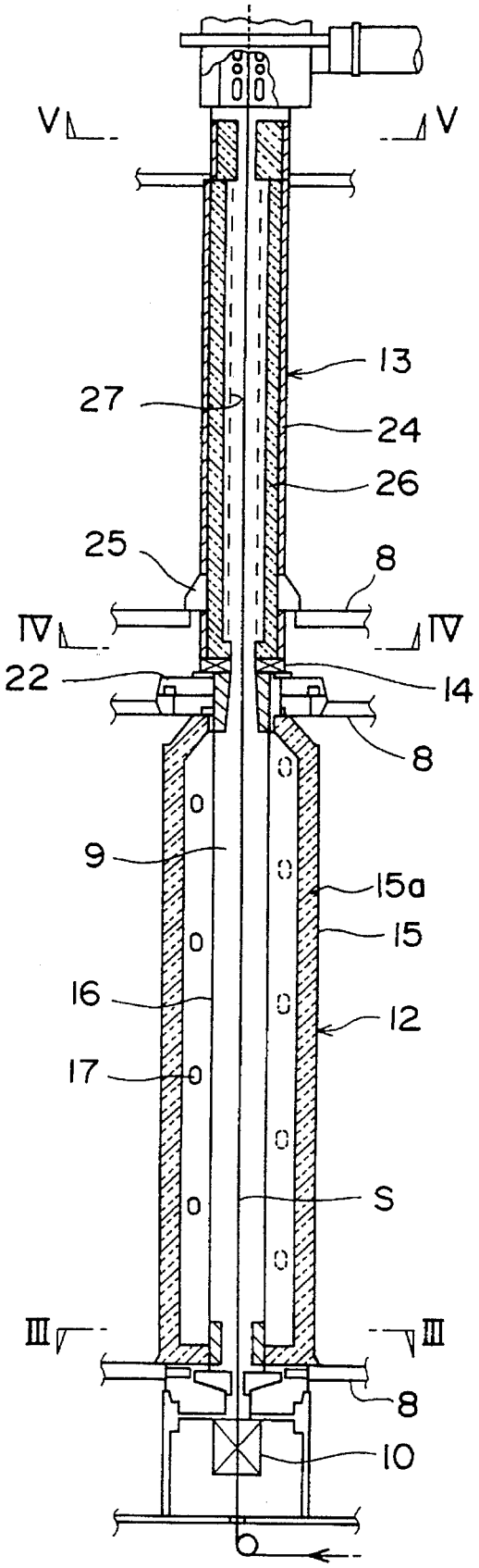
FIG. 2 is a side sectional view of a heating zone of the vertical bright-annealing furnace according to the present invention.
Figure 3:
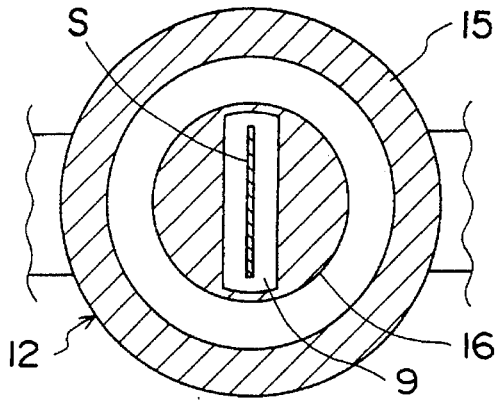
FIG. 3 is a cross-sectional view of a lower portion of a muffle-type heating station taken along the line III—III in FIG. 2.

As shown in FIGS. 2 and 3, the muffle-type heating station 13 is constructed of a metal shell 15 that is lined with heat-insulating material 15*a* such as, for example, ceramic fibers and a muffle 16 made of special heat-resistant steel such as one known under a trademark "Inconel 600" available from Inco Alloys International Ltd. of Canada. The interior space of the muffle 16 defines a part of the metal strip conveying channel 9. The muffle-type heating station 12 has first heating means which may be a plurality of burners 17 arranged in zigzag fashion so that air-fuel mixtures may be burned within the interior of the muffle-type heating station.

Figure 6:
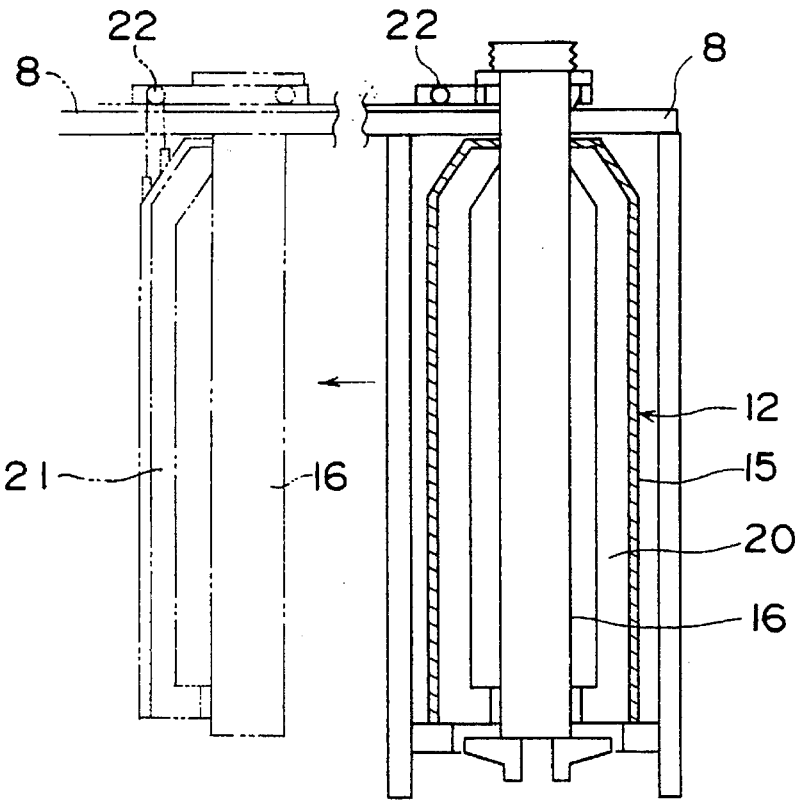
FIG. 6 is a fragmentary side sectional view showing the manner in which a muffle is detached from the heating station.
Figure 7:
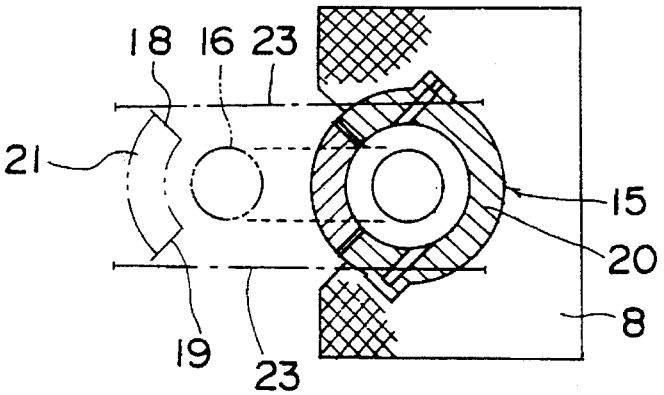
FIG. 7 is fragmentary transverse sectional view showing the manner in which a muffle is detached from the heating station.
Figure 8:
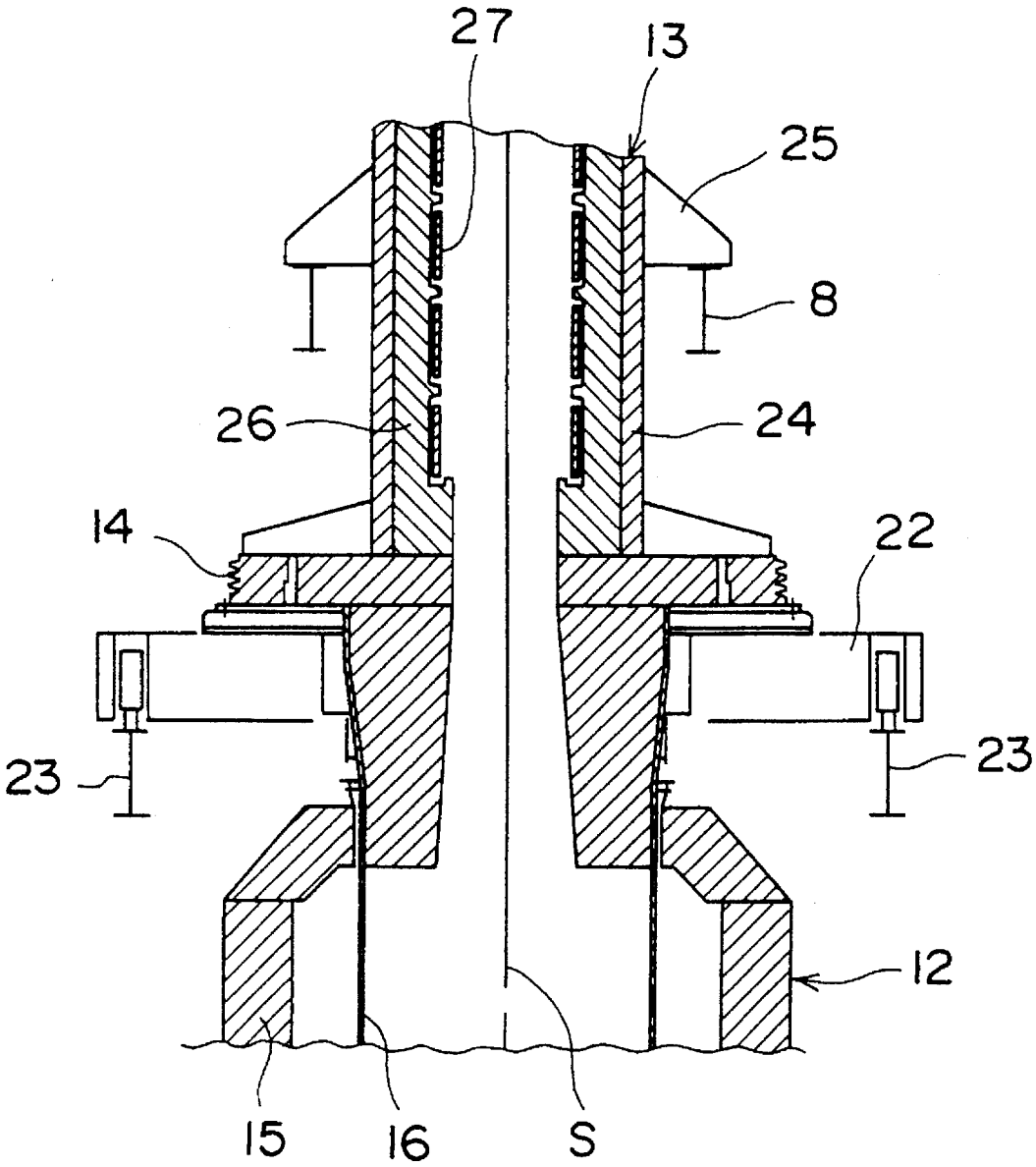
FIG. 8 is a partially side sectional view showing a connecting unit for the muffle-type and refractory-type heating stations.

As shown in FIGS. 6, 7, and 8, the metal shell 15 is of two-piece construction including a main part 20 and a detachable part 21 detachably joined to the main part 20. The muffle 16 is carried by the detachable part 21. These two parts 20 and 21 are defined by dividing the metal shell 15 longitudinally along longitudinal sections 18 and 19 spaced generally 90° about a longitudinal axis of the metal shell 15.

The main part 20 is fixed at its lower end to the structure 8, while the detachable part 21 is supported by the muffle 16 which is engaged at its upper portion with a carriage 22. The carriage 22 is movably mounted on parallel rails 23 disposed on the structure 8. The rails 23 extend in such a direction perpendicular to the longitudinal axis of the metal shell 15 and at an approximate angle of 45° relative to side faces of the respective sections 18 and 19 that the carriage 22 can be moved between a separated position, shown by the phantom line in FIGS. 6 and 7, and a closed position in which the detachable part 21 and the main part 20 together form the metal shell 15.

Therefore, when the muffle-type heating station 12 is released from the connecting unit 14 and the detachable part 21 is then released from the main part 20 the carriage 22 can be moved along the rails 23 so that the detachable part 21 accompanying the muffle 16 will be separated from the main part 20 as shown by the phantom line in FIGS. 6 and 7, and eventually the muffle 16 may be repaired and/or exchanged for a new one. Preferably, the muffle 16 has a wall thickness which decreases stepwise from top to bottom so that a tensile stress at the uppermost portion thereof due to its weight may be reduced.

Figure 4:
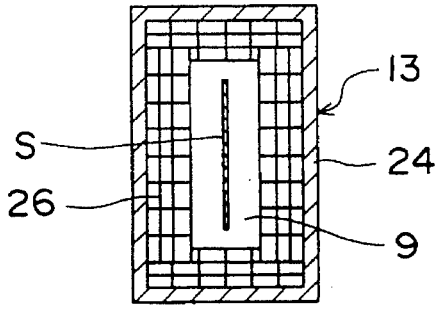
FIG. 4 is a cross-sectional view of a lower portion of a refractory-type heating station taken along the line IV—IV in FIG. 2.
Figure 5:
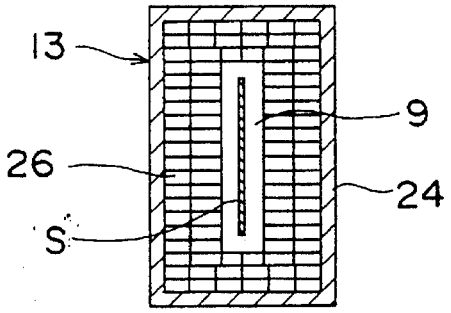
FIG. 5 is a cross-sectional view of a lower portion of a refractory-type heating station taken along the line V—V in FIG. 2.

The refractory-type heating station 13, which is fixed to the structure 8 through lower brackets 25, comprises a metal shell 24 having a rectangular cross-section as shown in FIGS. 4 and 5, and also having an interior space thereof defining another part of the metal strip conveying channel 9. The metal shell 24 has its inner surface formed of an insulating layer 26 which is made by lining firebricks to a predetermined height. On a radially inward surface of the insulating layer 26, there is provided second heating means which may be a plurality of electric heaters 27 disposed at regular intervals. Each electric heater 27 is preferably in the form of a heater of a type utilizing a corrugated heating wire made of, for example, molybdenum or a panel heater having the heating wire built therein.

The connecting unit 14, which is expandable along the longitudinal axis of the heating zone 3, communicates respective interior spaces of the muffle 16 and the refractory-type heating station 13 with each other in a gas-tight construction. Therefore, when the muffle 16 is to be separated from the metal shell 15, it can readily and easily be accomplished by a slight upward contraction of the connecting unit 14. Further, a heat expansion of the refractory-type heating station 13 is absorbed by the connecting unit 14.

The first and second cooling zone 4 and 5 include an slow-cooling unit 28 and a cooling unit 29, respectively. These units 28 and 29 are coupled with a gas supplying unit (not shown) from which air and/or gas of a required temperature is fed thereto. The number of the cooling unit 29 in the cooling zone 5 may be determined according its ability.

Each of the top-roll chamber 6 and the outlet chute 7 comprises a tubular shell having a rectangular or circular cross section. The top-roll chamber 6 has two guide rollers 30 accommodated therein for guiding the upward-moving metal so as to deflect downwardly towards the outlet chute 7.

Figure 9:
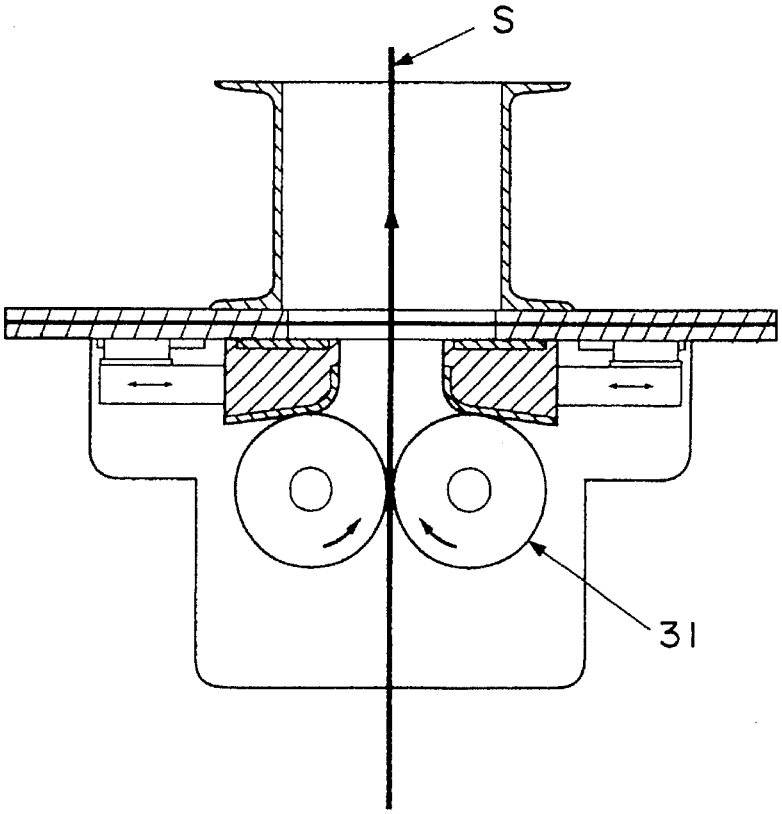
FIG. 9 is a vertical sectional view of a roll type seal unit.
Figure 10:
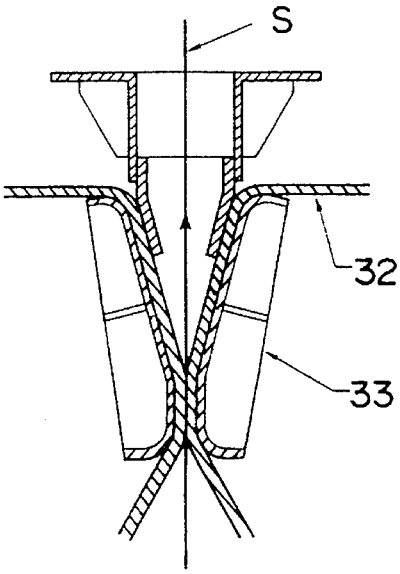
FIG. 10 is a vertical sectional view of a felt type seal unit.

Various types of seal units may be used in the inlet and outlet seal units 10 and 11. For example, roll type seal units having a pair of seal rolls 31 as shown in FIG. 9, or felt type seal units comprising felts 32 and metal members 33 for bringing the felt 32 contact with the metal strip may be used therefor.

In operating the annealing furnace 1, the atmospheric gas to be charged into the channel 9 may be an HN gas, that is, a mixture of hydrogen $H_2$ with nitrogen $N_2$ in a predetermined mixing ratio. Leakage of the atmospheric gas from the inlet portion of the heating zone 3 and the outlet portion of the outlet chute 7 are prevented by the respective seal units 10 and 11. The amount of supply of the atmospheric gas is preferably controlled so as to keep a pressure of about +25 to +50 mmAg in the channel 9. A gaseous mixture of fuel and air is fed to the burners 7 in the muffle-type heating station 12, and is burned within the interior of the station 12. The heater 27 of the refractory-type heating station 13 is electrically energized by the supply of predetermined voltage to emit heat.

Figure 11:
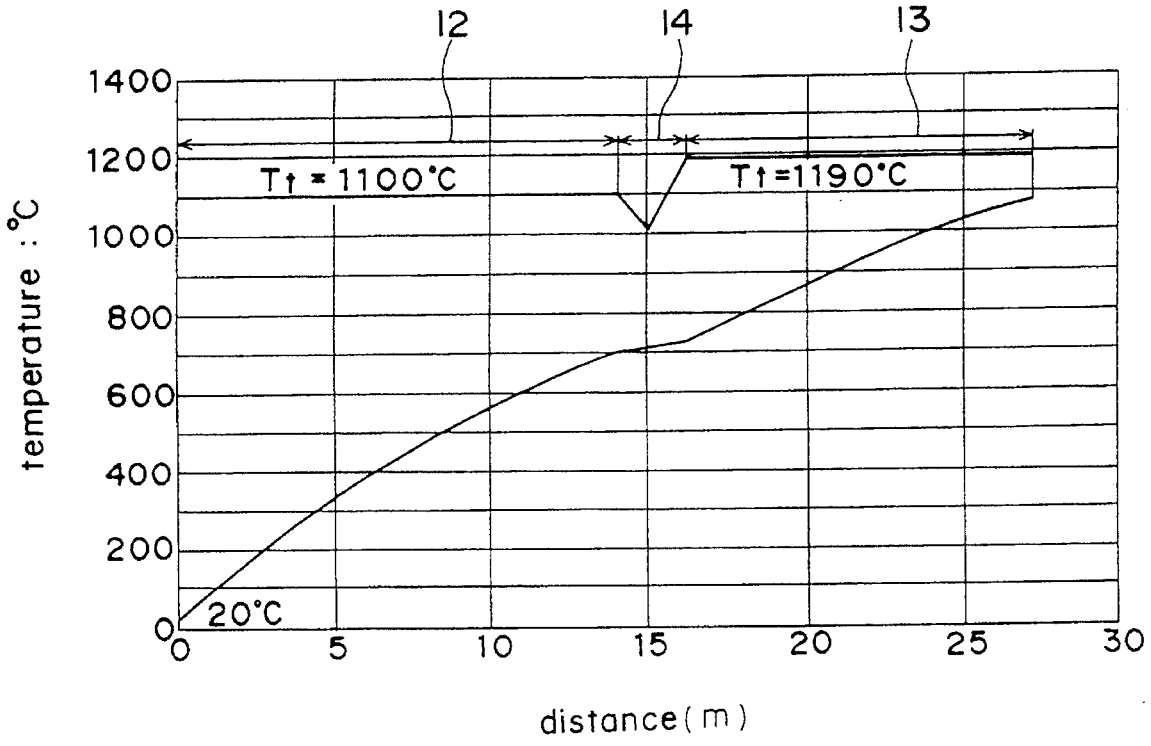
FIG. 11 is a graph showing changes in temperature of the metal strip in a heating zone.

As a result, the stainless strip S moving along the path 2 is, as shown in FIG. 11, heated up to about 700° C. by radiant heat from the muffle 16 in the muffle-type heating station 12. Next, the strip S is further heated up to about 1,100° C. by the electric heaters 27 in the refractory-type heating station 13. Then, the strip S is cooled down to about 800° C. in the slow-cooling zone 4 and, after having been further cooled down to about 80° C. in the cooling zone 5, transported to the subsequent process through the top-roll chamber 6 and the outlet chute 7.

While there has shown and described herein the up-heat type vertical annealing furnace in which the heating zone 3, first and second cooling zones 4 and 5 are disposed from bottom to top in this order so that the metal strip is annealed while being transported upwardly, this invention can be equally applied to a down-heat type in which the heating zone 3 is disposed above the first cooling zone, i.e., the slow-cooling zone 4 and the second cooling zone 5 is disposed beneath the first cooling zone 4 so that the metal strip can be annealed while being transported downwardly.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. A vertical bright-annealing furnace for continuous heat treatment of metal strips, comprising a heating zone for heating a metal strip to a predetermined annealing temperature and a cooling zone for cooling the heated metal strip to a predetermined low temperature, characterized in that said heating zone comprises:

a muffle-type heating station composed of a shell lined with a heat-insulating material, a muffle arranged in said shell, and a first heating means for heating said muffle; and a refractory-type heating station arranged just above said muffle-type heating station and composed of a shell lined with a heat-insulating material, and a second heating means for heating said metal strip;

said muffle-type and refractory-type heating stations being connected to one another by a flexible connecting unit which is extensible in the longitudinal direction of the heating zone, whereby allowing the metal strip to pass through the refractory-type heating station subsequent to the muffle-type heating station to heat it to a predetermined annealing temperature.

2. A vertical bright-annealing furnace as claimed in claim 1, wherein the first heating means comprises a plurality of burners.

3. A vertical bright-annealing furnace as claimed in claim 1, wherein the second heating means comprises a plurality of electric heaters arranged on the inner periphery of the cylindrical body.

4. A vertical bright-annealing furnace as claimed in claim 1, wherein the lined metal shell of said muffle-type heating station is divided into a fixed main part and a detachable part carrying the muffle.

5. A vertical bright-annealing furnace as claimed in claim 4, wherein the main part and detachable part are divided by two sections extending along a longitudinal axis of the lined metal shell.

* * * * *